US009286843B2

(12) United States Patent
Jang et al.

(10) Patent No.: US 9,286,843 B2
(45) Date of Patent: Mar. 15, 2016

(54) DISPLAY APPARATUS AND METHOD OF DRIVING THE SAME

(71) Applicant: SAMSUNG DISPLAY CO., LTD., Yongin, Gyeonggi-do (KR)

(72) Inventors: Yongjun Jang, Yongin-si (KR); Nam-Gon Choi, Asan-si (KR); Geunjeong Park, Daegu (KR); Hyundae Lee, Hwaseong-si (KR); Cheolwoo Park, Suwonsi (KR); Jeong-hun So, Hwaseong-si (KR); Bonghyun You, Yongin-si (KR); Yun Ki Baek, Suwon-si (KR); Kyoung Ho Lim, Suwon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 260 days.

(21) Appl. No.: 13/925,593

(22) Filed: Jun. 24, 2013

(65) Prior Publication Data

US 2014/0204104 A1 Jul. 24, 2014

(30) Foreign Application Priority Data

Jan. 24, 2013 (KR) ..... 10-2013-0008176

(51) Int. Cl.

| | |
|---|---|
| ***G09G 3/36*** | (2006.01) |
| ***G09G 5/36*** | (2006.01) |
| ***G09G 5/39*** | (2006.01) |
| ***G09G 3/20*** | (2006.01) |

(52) U.S. Cl.

CPC ..... *G09G 3/3648* (2013.01); *G09G 3/20* (2013.01); *G09G 5/363* (2013.01); *G09G 2300/0426* (2013.01); *G09G 2330/028* (2013.01); *G09G 2360/12* (2013.01)

(58) Field of Classification Search

None

See application file for complete search history.

(56) References Cited

U.S. PATENT DOCUMENTS

| | | | | |
|---|---|---|---|---|
| 7,619,590 | B2 | 11/2009 | Kim | |
| 7,843,525 | B2 | 11/2010 | Tsumura et al. | |
| 8,031,136 | B2 | 10/2011 | Cho et al. | |
| 2006/0202917 | A1 | 9/2006 | Moon | |
| 2006/0274029 | A1* | 12/2006 | Hong et al. | 345/104 |
| 2009/0267954 | A1 | 10/2009 | Cupps et al. | |
| 2010/0289781 | A1 | 11/2010 | Kim et al. | |
| 2011/0148826 | A1* | 6/2011 | Koyama et al. | 345/204 |
| 2011/0148832 | A1* | 6/2011 | Nie et al. | 345/207 |
| 2012/0042275 | A1 | 2/2012 | Neerudu et al. | |

FOREIGN PATENT DOCUMENTS

| | | |
|---|---|---|
| KR | 1020050013414 | 2/2005 |
| KR | 10-2006-0069142 | 6/2006 |
| KR | 10-2007-0101661 | 10/2007 |

* cited by examiner

*Primary Examiner* — Joseph Feild
*Assistant Examiner* — Emily Frank
(74) *Attorney, Agent, or Firm* — Innovation Counsel LLP

(57) ABSTRACT

A display apparatus includes pixels connected to gate lines and data lines, a gate driver configure to drive the gate lines, a data driver including a plurality of data driving parts configured to drive the data lines. The control board includes a processor that outputs an image signal and a control signal and a timing controller that outputs a first control signal to control the gate driver and a second control signal and a data signal to control the data driver in response to the image signal and the control signal.

18 Claims, 10 Drawing Sheets

DISPLAY APPARATUS AND METHOD OF DRIVING THE SAME

CROSS-REFERENCE TO RELATED APPLICATION

This application claims priority under 35 U.S.C. §119 to Korean Patent Application No. 10-2013-0008176, filed on Jan. 24, 2013, the disclosure of which is incorporated by reference herein in its entirety.

BACKGROUND

1. Field of Disclosure

Embodiments of the present disclosure relate to a display apparatus and method of driving the display apparatus.

2. Description of the Related Art

In recent years, various display apparatuses, such as a liquid crystal display, a field emission display, a plasma display, an organic light emitting display, etc., haven been widely used.

Such display apparatuses are applied to various image display devices, e.g., a television set, a computer monitor, etc., to display images and texts. In particular, an active-matrix type liquid crystal display that drives liquid crystal cells using thin film transistors has advantages such as superior image quality, low power consumption, large display size and high definition, etc.

In general, the display apparatus is applied to the personal computer and the television set, but recently, demand for the display apparatus keeps on increasing in various fields (or in the market) such as a digital information display for a digital signage, e.g., a personal digital frame, a commercial sign board, a public information desk, etc.

SUMMARY

Embodiments of the present disclosure provide a display apparatus including a control board, which includes a processor for digital information processing.

The present disclosure provides a display apparatus including the control board with the processor for the digital information processing.

Embodiments of the inventive concept provide a display apparatus including a plurality of pixels connected to a plurality gate lines and a plurality of data lines, a gate driver that drives the gate lines, a data driver that includes a plurality of data driving parts to drive the data lines, and a control board that includes a processor that outputs an image signal and a control signal, and a timing controller that outputs a first control signal to control the gate driver, and a second control signal and a data signal to control the data driver in response to the image signal and the control signal.

In example embodiments, the processor communicates with an external device over wireless network using at least one of WiHD (wireless HD), WHDi (wireless home digital interface), WiFi (wireless LAN), Bluetooth, Zigbee, or binary CDMA (code division multiple access).

In example embodiments, the control board further includes a wireless interface to communicate with an external device over wireless network using at least one of WiHD (wireless HD), WHDi (wireless home digital interface), WiFi (wireless LAN), Bluetooth, Zigbee, or binary CDMA (code division multiple access).

In example embodiments, the processor and the timing controller are integrated in a single chip.

In example embodiments, the timing controller is realized by a field-programmable gate array (FPGA) and connected to the processor through a bus.

In example embodiments, the bus is suitable for an advanced microcontroller bus architecture and protocol standard.

In example embodiments, the timing controller further comprises a memory and the timing controller is realized by the field-programmable gate array together with a memory control module, a display tuning module, and a graphic processor.

In example embodiments, the memory management control module manages to access the memory, the display tuning module changes a characteristic parameter of the processor, and the graphic processor performs graphic processing on the image signal and provides the processed image to the processor.

In example embodiments, the control board further includes a memory, a first bus that connects the memory and the processor, and a second bus that connects the memory and the field-programmable gate array.

In example embodiments, the control board further includes a power management unit to manage a source voltage required to drive the display apparatus, the power management unit is connected to a rechargeable battery and charges the battery when the battery is connected to an external source.

In example embodiments, the battery is disposed on a rear surface of the display apparatus.

The processor includes a display tuning unit that changes an operation parameter of the timing controller, an image processing unit that processes an image information from an external source to output the image signal, and a frame speed changing processor that changes a frequency of the image signal to apply the image signal having the changed frequency to the timing controller.

In example embodiments, the processor is an advanced RISC machines processor.

In example embodiments, the display apparatus further includes a first circuit board electrically connects a first data driving part and the control board, and a second circuit board electrically connects a second data driving part and the control board.

In example embodiments, the control board is mounted on a first circuit board or a second circuit board, and the first and the second circuit boards are electrically connected to each other.

The display apparatus further includes a first cable that electrically connects a first circuit board and the control board and a second cable that electrically connects a second circuit board and the control board.

Embodiments of the inventive concept provide a method of driving a display apparatus including preparing a data using a signal applied to a processor from a host device, performing a graphic process on the data using the processor, applying the graphic-processed data to the timing controller, controlling the timing controller to allow an image to be displayed on the display apparatus on the basis of the graphic-processed data, and changing a parameter set in the display apparatus using the processor in accordance with a user's set.

In example embodiments, the signal is applied to the process in a wireless communication from the host device.

In example embodiments, the method further includes performing a self-test function.

In example embodiments, the timing controller is realized by a field-programmable gate array (FPGA) and connected to the processor through a bus.

According to the above, the control board includes the processor and the timing controller, which are integrated in a single chip. Therefore, the display apparatus for the digital signage may be easily realized. In addition, the control board receives the source voltage from the battery, and thus the display apparatus may be easily installed and operated in a place in which no power consent exists. Further, the operation mode of the display apparatus and the self-test function of the display apparatus may be performed by the processor included in the control board.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
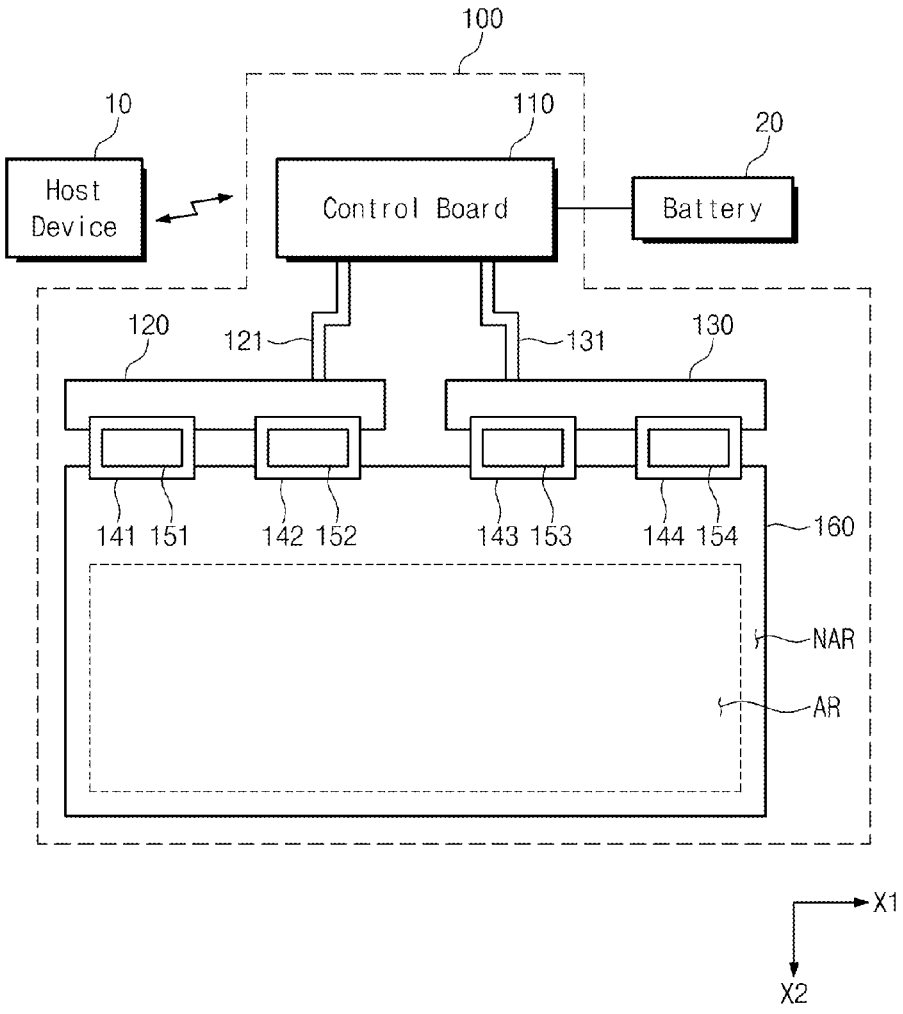
FIG. 1 is a block diagram showing a display apparatus according to an exemplary embodiment of the present disclosure.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

FIG. 1 is a block diagram showing a display apparatus according to an exemplary embodiment of the present disclosure.

Referring to FIG. 1, a display apparatus 100 includes a control board 110, a first circuit board 120, a second circuit board 130, data driving circuits 141 to 144, and a display panel 160.

The display apparatus 100 may be a liquid crystal display, a plasma display, an organic light emitting display, or a field emission display.

The control board 110 in the display apparatus 100 may communicate with a host device 10 over wireless network. The control board 110 receives image information and signals used to control the display apparatus 100 from the host device 10. The host device 10 may be a set top box or a computer, which is required for a video-on-demand (VOD), a TV home shopping, a network game, etc., or may be a wireless internet sharer or a line sharer, which is connected to internet. The control board 110 performs various functions related to transmission of image signals, audio signals, and data transmissions.

The control board 110 in the display apparatus 100 is connected to a battery 20. The battery 20 is a rechargeable battery, e.g., a lithium-ion battery, a nickel cadmium battery, a nickel-hydrogen battery, a lithium polymer battery, a phosphate iron lithium battery, etc., to provide a source voltage required to drive the display apparatus 100. The control board 110 receives the source voltage from the battery 20, and controls operations of the display apparatus 100 and a charge of the battery 20 in accordance with a remaining amount of the battery 20.

Since the display apparatus 100 receives the source voltage from the battery 20, the display apparatus 100 is easily installed in a place in which no power consent exists. Therefore, a utilization of a digital information display (DID) applied to various devices, e.g., a personal digital frame, a commercial sign board, a public information desk, etc., may be improved.

The control board 110 is electrically connected to the first circuit board 120 through a first cable 121 and electrically connected to the second circuit board 130 through a second cable 131. The control board 110 applies image data and a control signal to the data driving circuits 141 and 142 through the first cable 121 and applies the image data and the control signal to the data driving circuits 143 and 144 through the second cable 131. The control signal applied to the data driving circuits 141 to 144 from the control board 110 includes a horizontal synchronization start signal, a clock signal, and a line latch signal.

The first circuit board 120 and the second circuit board 130 include various circuits to drive the display panel 160. The first circuit board 120 includes plural lines used to connect the control board 110, and the data driving circuits 141 and 142 and the second circuit board 130 includes plural lines used to connect the control board 110 and the data driving circuits 143 and 144. The first circuit board 410 and the second circuit board can be formed on one circuit board.

Data driving integrated circuits 151 to 154 are respectively mounted on the data driving circuits 141 to 144 or are directly mounted on a display panel 160 without using the first circuit board 120 or the second circuit board 130. Each of the data driving integrated circuits 151 to 154 drives data lines arranged on the display panel 160 in response to the data signal and the control signal from the control board 110.

The display panel 160 includes a display area AR in which a plurality of pixels is arranged and a non-display area NAR disposed on peripheral area of the display area AR. The image is displayed in the display area AR and is not displayed in the non-display area NAR. The display panel 160 may include a glass substrate, a silicon substrate, or a film substrate.

The data driving circuits 141 to 144 are disposed adjacent to one side of the display panel 410 and arranged in a first direction X1, but they should not be limited thereto or thereby. That is, the data driving circuits 141 to 144 may be arranged in a second direction X2 or arranged in the first and second directions X1 and X2.

Although not shown in figures, the display apparatus 100 further includes a gate driving circuit, and the gate driving circuit is provided in the tape carrier package structure, the chip on film structure or chip on glass structure and attached to a non-display area of the display panel 160. According to another embodiment, the gate driving circuit includes a gate driver IC, but the gate driving circuit should not be limited to the gate driver IC. That is, the gate driving circuit may be configured to include a circuit made of oxide semiconductor, amorphous semiconductor, crystalline semiconductor, or polycrystalline semiconductor.

The control board 110 that controls timings of the image signal and control signal provided to the display apparatus 100 is important to drive the display apparatus 100. In particular, the control board 110 includes a timing controller (not shown) that outputs the image signal and the control signal, and a processor (not shown) that performs communicated with the host device 10 over wireless network, changes a characteristic parameter of the display apparatus 100, and performs a self-test function. The timing controller and the processor, which are included in the control board 110, will be described in detail later.

Figure 2:
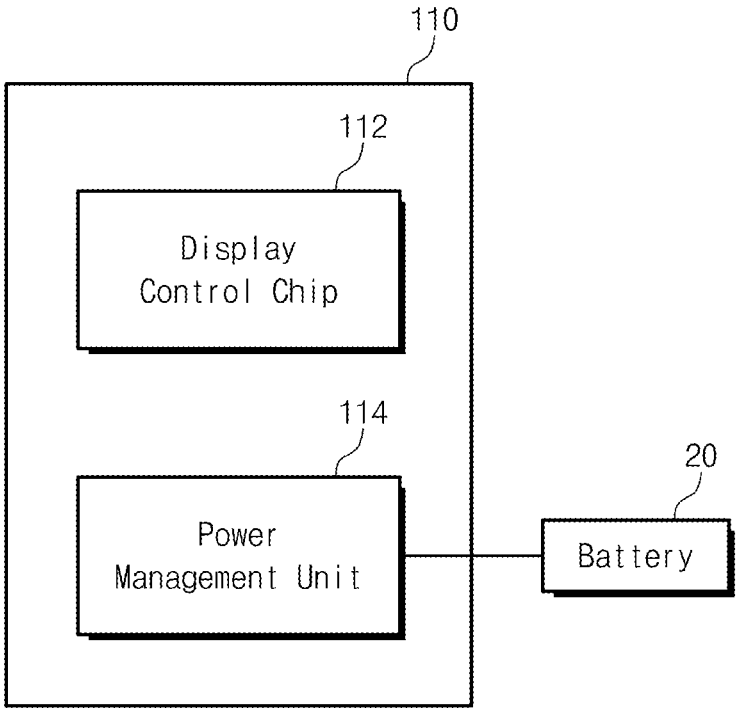
FIG. 2 is a block diagram showing a control board shown in FIG. 1.

FIG. 2 is a block diagram showing a control board shown in FIG. 1.

Referring to FIG. 2, the control board 110 includes a display control chip 112 and a power management unit 114. The display control chip 112 includes the timing controller and the processor to perform the wireless communication with the host device 10 shown in FIG. 1, change the characteristic parameter, and perform the self-test function.

The power management unit 114 which is connected to the battery 20 to receive the source voltage from the battery 20 provides information of the remaining amount of the battery 20 to the display control chip 112, and controls the charge of the battery 20 when the battery 20 is connected to an external power source (not shown).

Figure 3:
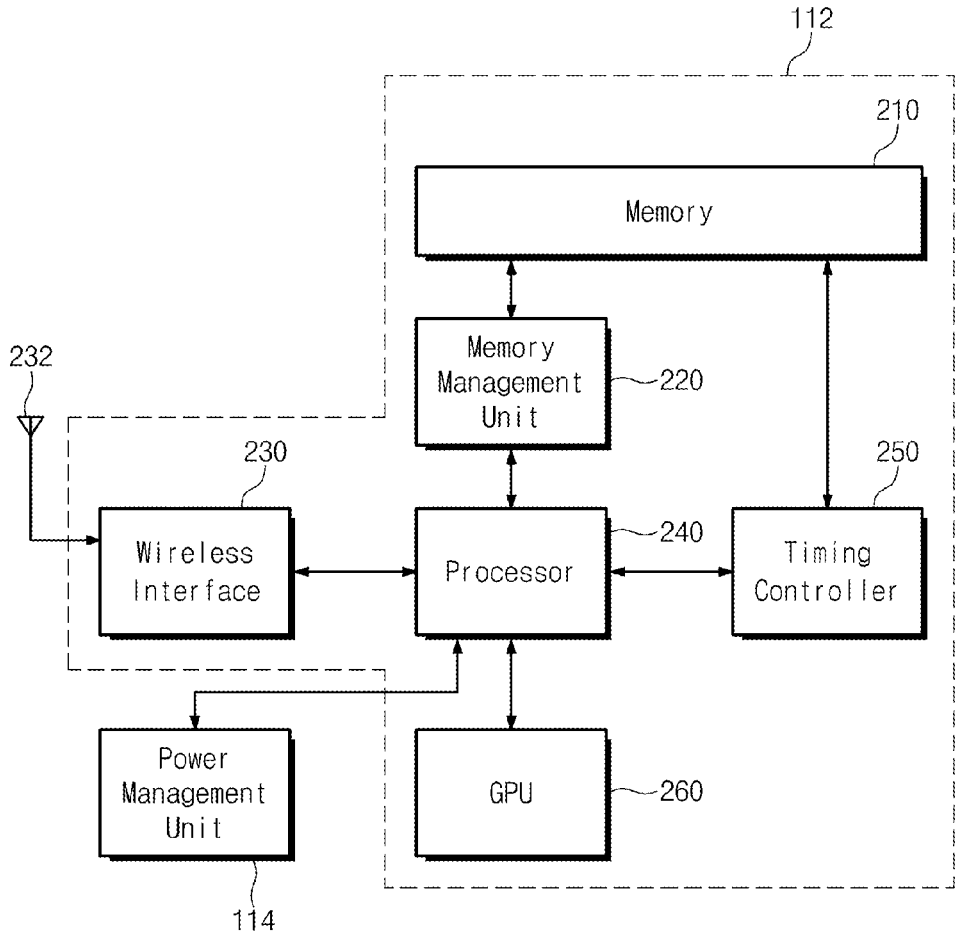
FIG. 3 is a block diagram showing a display control chip in the control board shown in FIG. 2.

FIG. 3 is a block diagram showing the display control chip in the control board shown in FIG. 2.

Referring to FIG. 3, the display control chip 112 includes a memory 210, a memory management unit 220, a wireless interface 230, a processor 240, a timing controller 250, and a graphic processing unit 260. The memory 210 includes a static memory, e.g., an erasable programmable read-only memory (EPROM), an electrically erasable programmable read-only memory (EEPROM), a flash memory, a random access memory (RAM), a read only memory (ROM), etc., and/or a dynamic memory.

The memory management unit 220 manages the access of the processor 240 to the memory 210. For instance, the memory management unit 220 converts a virtual memory address to a real memory address and performs functions, e.g., protection of the memory 210, management of cache, and arbitration of bus. According to another embodiment, the memory management unit 220 may be included in the processor 240 rather than a separate hardware device.

The wireless interface 230 performs an interface function for wireless communication with the host device 10 shown in FIG. 1. For instance, the wireless interface 230 communicates with the host device 10 over wireless network using at least one of WiHD (wireless HD), WHDi (wireless home digital interface), WiFi (wireless LAN), Bluetooth, Zigbee, or binary CDMA (code division multiple access). The wireless interface 230 receives a signal provided from the host device 10 through an antenna 232 and provides the signal to the processor 240, and provides a signal from the processor 240 to the host device 10 through the antenna 232. Although not shown in figures, the processor 240 may wire-communicate with the host device 10 through a separate cable without using the wireless interface 230.

The processor 240 communicates with the host device 10 shown in FIG. 1 through the wireless interface 230. The processor 240 provides the image signal and the control signal received from the host device 10 to the timing controller 250. The graphic processing unit (GPU) 260 is connected to the processor 240. The graphic processing unit 260 performs graphic processing on the image signal received from the host device 10 and provides the processed image to the processor 240. The processor 240 provides the image signal, which is graphic processed, to the timing controller 250. In the present exemplary embodiment the processor 240 and the graphic processing unit 260 are separated from each other, but the processor 240 and the graphic processing unit 260 may be realized in a single processor according to embodiments.

When a frequency of the image signal provided from the host device 10 is not matched with a frequency of the display panel 160, the processor 240 converts the frequency of the image signal suitable for the display panel 160 and then provides the image signal to the timing controller 250. In addition, the processor 240 changes parameters, e.g., an operating voltage, a frequency of a clock signal, etc., set in the timing controller 250. Further, the processor 240 may perform the self-test function to test whether or not elements included in the control board 110 and the display apparatus 100 are operated normally.

The processor 240 is connected to the power management unit 114. The processor 240 controls the operation of the display apparatus 100 in accordance with the remaining amount of the battery 20, which is provided from the power management unit 114. In detail, when the remaining amount of the battery 20 is lower than a reference level, the processor 240 controls the display panel 160 such that the display panel 160 is operated in a power save mode, thereby lowering brightness of the display panel 160. In addition, the processor 240 controls the remaining amount of the battery 20 to be displayed on the display panel 160, and thus a user recognizes the information of the remaining amount of the battery 20.

As an example, the processor 240 may be an ARM processor manufactured by ARM (Advanced RISC Machines) Co. Ltd.

The memory 210, the memory management unit 220, the wireless interface 230, the processor 240, the timing controller 250, and the graphic processing unit 260 of the display control chip 112 may be integrated in a single chip.

Figure 4A:
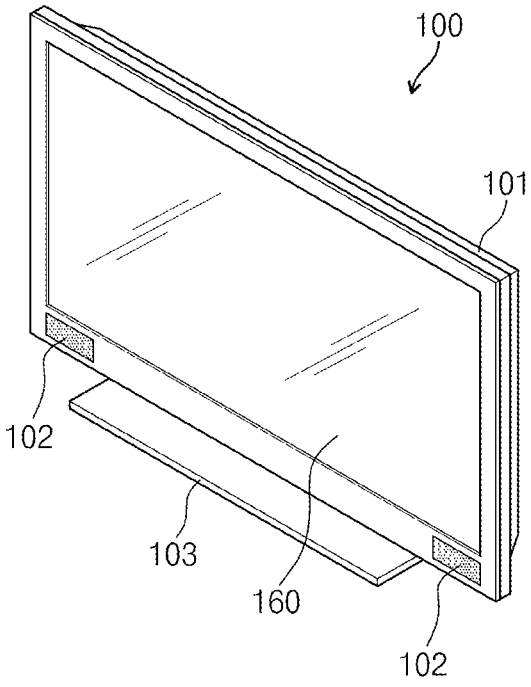
FIG. 4A is a perspective view showing an appearance of the display apparatus shown in FIG. 1.
Figure 4B:
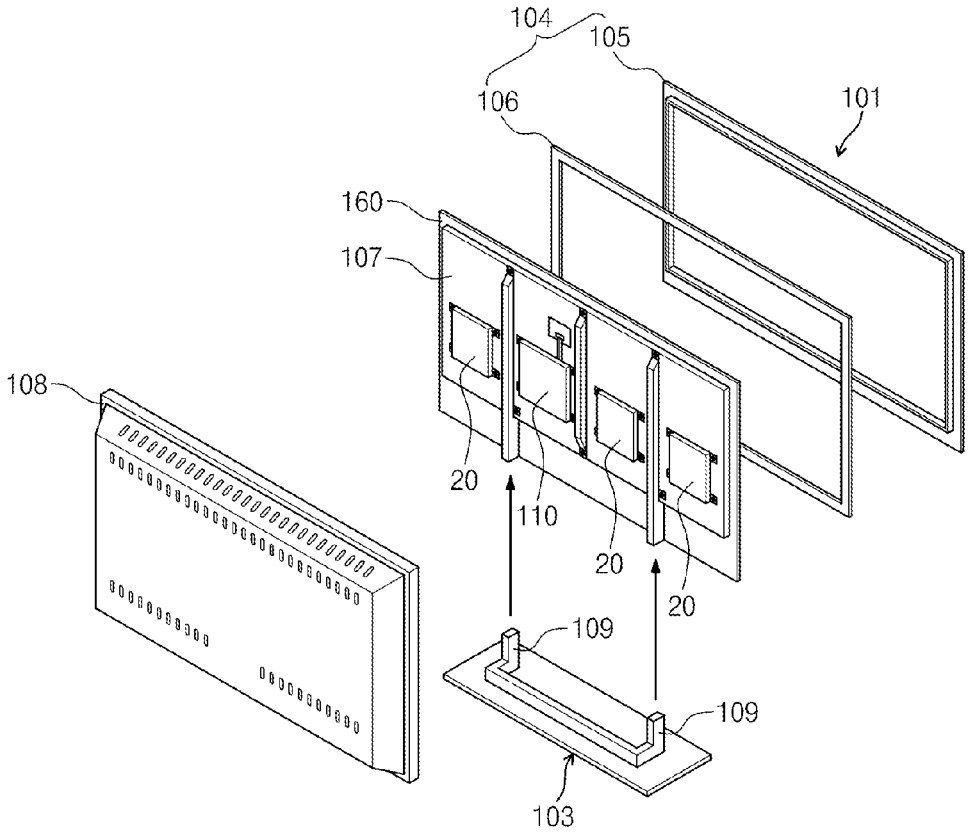
FIG. 4B is an exploded perspective view showing the display apparatus shown in FIG. 4A.

FIG. 4A is a perspective view showing an appearance of the display apparatus shown in FIG. 1 and FIG. 4B is an exploded perspective view showing the display apparatus shown in FIG. 4A.

Referring to FIG. 4A, the display apparatus 100 includes the display panel 160. The display panel 160 is supported and fixed by a housing 101. Speakers 102 are respectively installed at lower left and right side portions of the housing 101. The housing 101 is supported by a stand 103. The stand 103 has a structure attachable to and detachable from the housing 101.

Referring to FIG. 4B, the housing 101 of the display apparatus 100 includes a front case 104 and a rear case 108 and the display apparatus 100 is accommodated between the front case 104 and the rear case 108. The front case 104 includes a front vessel 105 and a vessel base 106, which surround the display panel 160. The rear case 108 is formed of a plastic material. A circuit mount board 107 is disposed on a rear surface of the display panel 160. The control board 110 shown in FIG. 1 is mounted on the circuit mount substrate 107. The stand 103 includes a pair of fastening members 109. The fastening members 109 are protruded upward to support the housing 101. The battery 20 is provided in a plural number and the batteries are mounted on the circuit mount board 107. The display apparatus 100 requires the plural batteries 20 to supply the source voltage used to display the image for a long time. The circuit mount board 107 may be expanded to have a size corresponding to that of the display panel 160, and thus the batteries 20 may be arranged on the circuit mount board 107.

Figure 5:
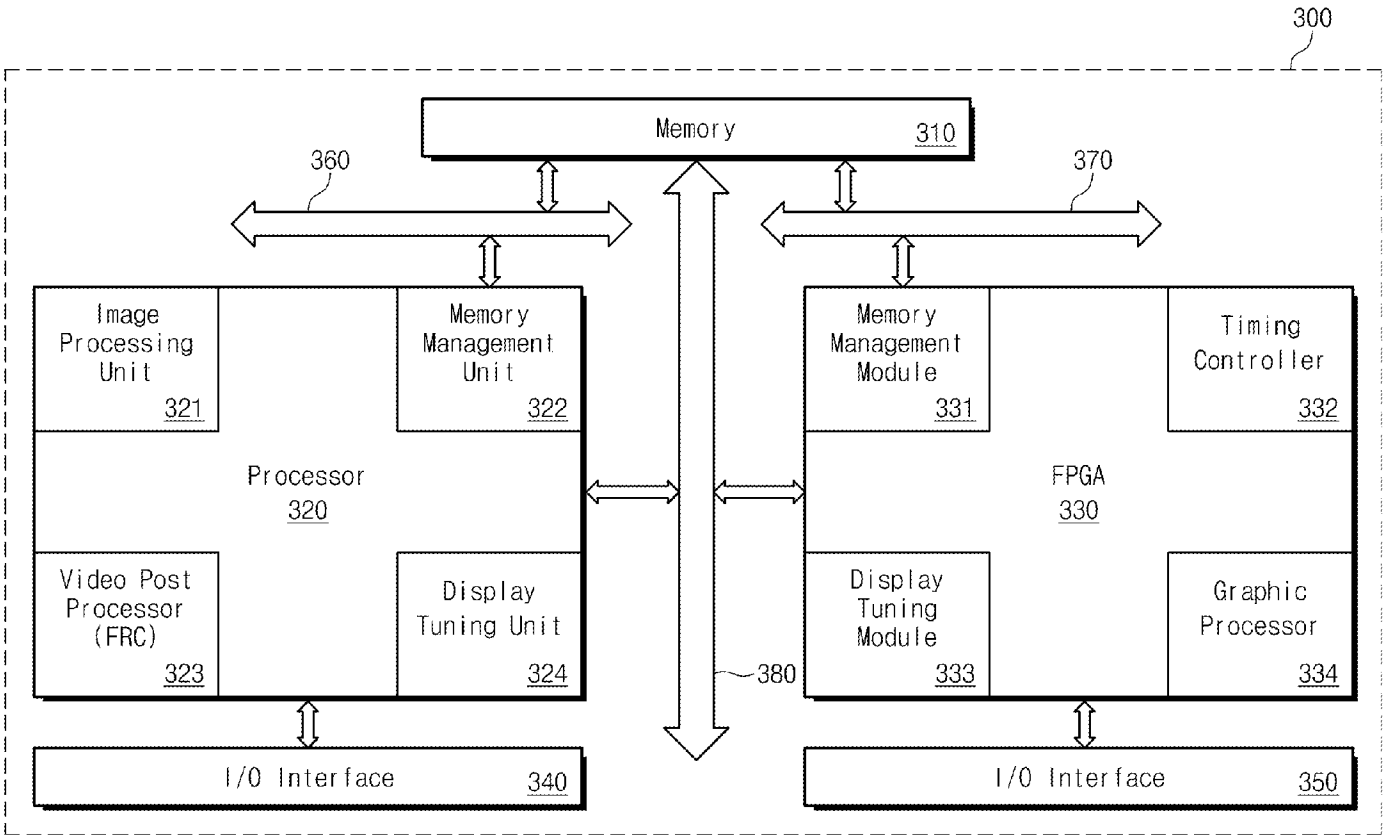
FIG. 5 is a block diagram showing a control board shown in FIG. 1 according to another exemplary embodiment of the present disclosure.

FIG. 5 is a block diagram showing a control board shown in FIG. 1 according to another exemplary embodiment of the present disclosure.

Referring to FIG. 5, a control board 300 includes a memory 310, a processor 320, a field-programmable gate array (FPGA) 330, input/output interfaces 340 and 350, and buses 360, 370, and 380.

The memory 310 includes a static memory, e.g., an erasable programmable read-only memory (EPROM), an electrically erasable programmable read-only memory (EEPROM), a flash memory, a random access memory (RAM), a read only memory (ROM), etc., and/or a dynamic memory.

The processor 320 communicates with the host device 10 shown in FIG. 1 through the input/output interface 340. The processor 320 receives the image signal and the control signal from the host device 10 and applies the image signal and the control signal to the timing controller 332 in the FPGA 330. The input/output interface 340 allows the processor 320 and the host device 10 to be communicated with each other over wireless network using at least one of WiHD, WHDi, WiFi, Bluetooth, Zigbee, or binary CDMA. In addition, the input/output interface 340 is connected to the host device 10 through a separate cable.

The processor 320 includes an image processing unit 321, a memory management unit 322, a video post processor 323, and a display tuning unit 324. The image processing unit 321, the memory management unit 322, the video post processor 323, and the display tuning unit 324 may be realized in a software.

The image processing unit 321 performs graphic processing on the image signal provided from the host device 10 and provides the processed image to the timing controller 332.

The memory management unit 322 manages the access of the processor 320 to the memory 310. For instance, the memory management unit 322 converts a virtual memory address to a real memory address and performs functions, e.g., protection of the memory 310, management of cache, and arbitration of buses.

When a frequency of the image signal provided from the host device 10 is not matched with a frequency of the display panel 160, the video post processor 323 converts the frequency of the image signal suitable for the display panel 160.

The display tuning unit 324 changes parameters, e.g., an operating voltage, a frequency of a clock signal, etc., set in the processor 320. Further, the processor 320 may perform self-test functions of elements included in the processor 320. In addition, the display tuning unit 324 may test whether or not elements included in the FPGA 330 are operated normally.

The processor 320 controls operations of the image processing unit 321, the memory management unit 322, the video post processor 323, and the display tuning unit 324. In addition, the processor 320 is connected to the battery 20 shown in FIG. 1 through the input/output interface 340. The processor 320 controls the operation of the display apparatus 100 in accordance with the remaining amount of the battery 20. In detail, when the remaining amount of the battery 20 is lower than a reference level, the processor 320 controls the display panel 160 such that the display panel 160 is operated in a power save mode, thereby lowering brightness of the display panel 160. In addition, the processor 320 controls the remaining amount of the battery 20 to be displayed on the display panel 160, and thus the user recognizes the information of the remaining amount of the battery 20. As an example, the processor 320 may be an ARM processor manufactured by ARM (Advanced RISC Machines) Co. Ltd.

The FPGA 330 includes a memory management module 331, a timing controller 332, a display tuning module 333, and a graphic processor 334. The memory management module 331 performs a control operation required when the FPGA 330 accesses the memory 310.

The memory management module 331 manages the access of the FPGA 330 with respect to the memory 310. For instance, the memory management module 331 converts a virtual memory address to a real memory address and performs functions, e.g., protection of the memory 310, management of cache, and arbitration of bus.

Responsive to the image signal and the control signal from the processor 320, the timing controller 332 outputs a first control signal that controls a gate driving circuit such that the image is displayed on the display panel 160, and a second control signal and a data signal that control a data driving circuit. The timing controller 332 stores the image signal provided from the processor 320 in the memory 310.

The display tuning unit 324 changes parameters, e.g., an operating voltage, a frequency of a clock signal, etc., set in the timing controller 332. In addition, the display tuning unit 324 may perform the self-test function to test whether elements included in the FPGA 330 are operated normally or not.

The graphic processor 334 performs a calculation process on the image signal provided from the processor 320.

The processor 320 and the FPGA 330 are connected to each other through the bus 380. The processor 320 and the memory 310 are connected to each other through the bus 360. The FPGA 330 and the memory 310 are connected to each other through the bus 370. Each of the buses 360, 370, and 380 follows an AMBA (Advanced Microcontroller Bus Architecture) protocol standard.

Figure 6:
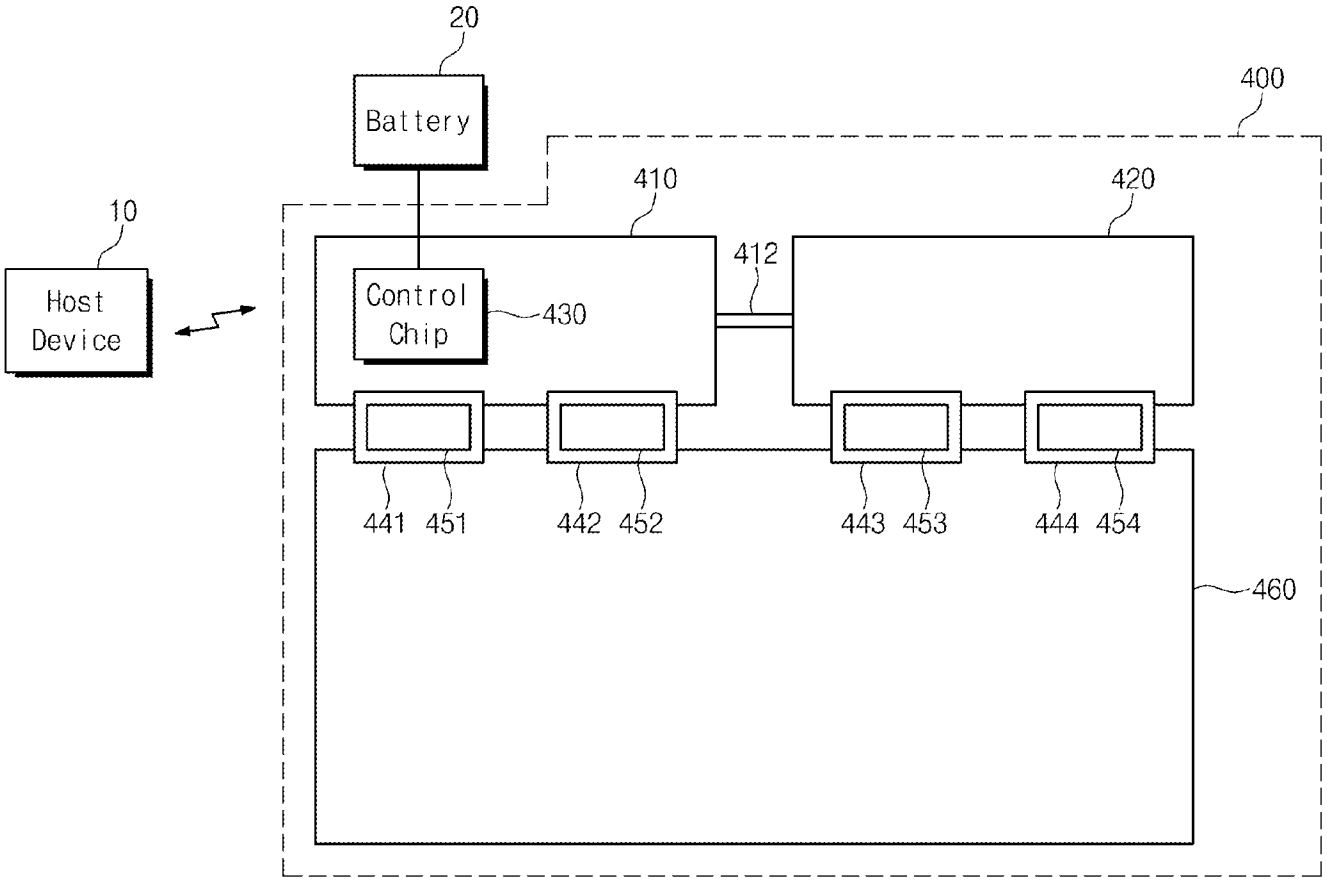
FIG. 6 is a block diagram showing a display apparatus according to an exemplary embodiment of the present disclosure.

FIG. 6 is a block diagram showing a display apparatus according to an exemplary embodiment of the present disclosure.

Referring to FIG. 6, a display apparatus 400 includes a first circuit board 410, a second circuit board 420, data driving circuits 441 to 444, and a display panel 460. Data driving integrated circuits 451 to 454 are respectively mounted on the data driving circuits 441 to 444.

Different from the control board 110 of the display apparatus shown in FIG. 1, a control chip 430 is mounted on the first circuit board 410. The first circuit board 410 and the second circuit board 420 are electrically connected to each other through a cable 412. Image data and control signals for the data driving circuits 443 and 444, which are output from the control chip 430, are directly applied to the first circuit board 410. The image data and the control signals for the data driving circuits 443 and 444, which are output from the control chip 430, are applied to the second circuit board 420 through the first circuit board 410 and a cable 412.

The control chip 430 communicates with the host device 10 over wireless network and receives the source voltage from the battery 20.

FIG. 6 shows the control chip 430 on the first circuit board 410, but it should not be limited thereto or thereby. That is, the control chip 430 may be mounted on the second circuit board 420 instead of the first circuit board 410. In this case, the image signals and the control signals for the data driving circuits 441 and 442, which are output from the control chip 430, are applied to the first circuit board 410 from the second circuit board 420 through the cable 412. The first circuit board 410 and the second circuit board can be formed on one circuit board.

Figure 7:
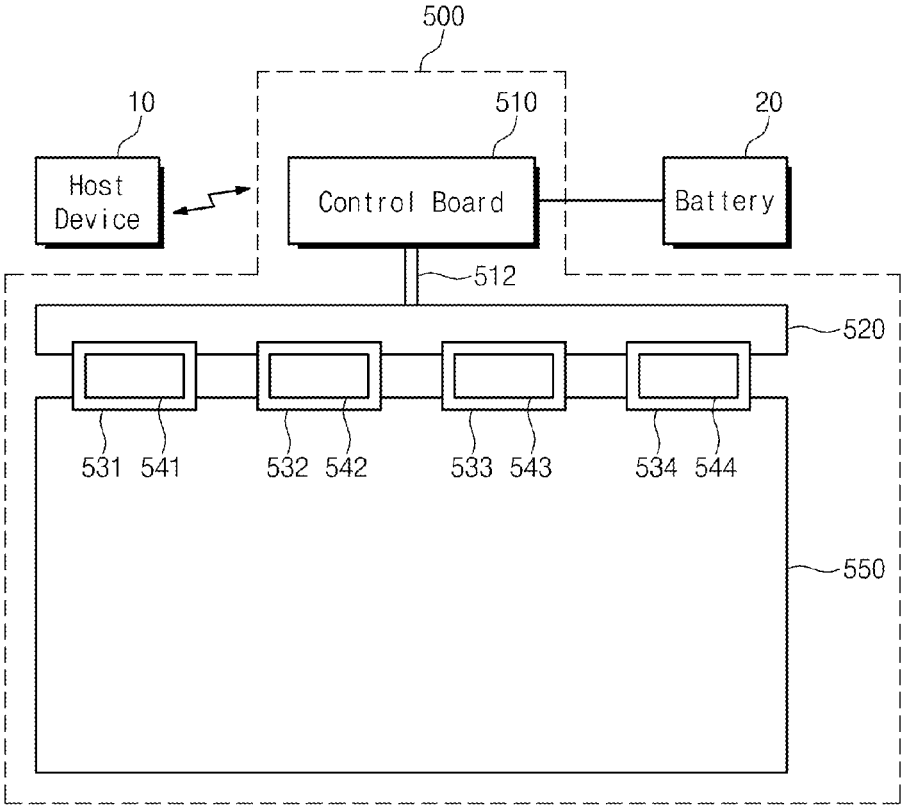
FIG. 7 is a block diagram showing a display apparatus according to an exemplary embodiment of the present disclosure.

FIG. 7 is a block diagram showing a display apparatus according to an exemplary embodiment of the present disclosure.

Referring to FIG. 7, a display apparatus 500 includes a control board 510, a circuit board 520, data driving circuits 531 to 534, and a display panel 550. Data driving integrated circuits 541 to 544 are respectively mounted on the data driving circuits 531 to 534.

The display apparatus 100 shown in FIG. 1 includes at least two circuit boards, e.g., the first and second circuit boards 120 and 130, which are separated from each other, but the display apparatus 500 shown in FIG. 7 includes a single circuit board 520. The circuit board 520 includes various circuits to drive the display panel 550. The single circuit board 520 includes a plurality of lines connected to the control board 510 and the data driving circuits 531 to 534.

Data driving integrated circuits 541 to 544 are respectively mounted on the data driving circuits 531 to 534 or are directly mounted on a display panel 160 without using the first circuit board 120 or the second circuit board 130. Each of the data driving integrated circuits 541 to 544 drives data lines arranged on the display panel 550 in response to a data signal and a control signal from the control board 510.

The control board 510 communicates with the host device 10 over wireless network and receives the source voltage from the battery 20.

Figure 8:
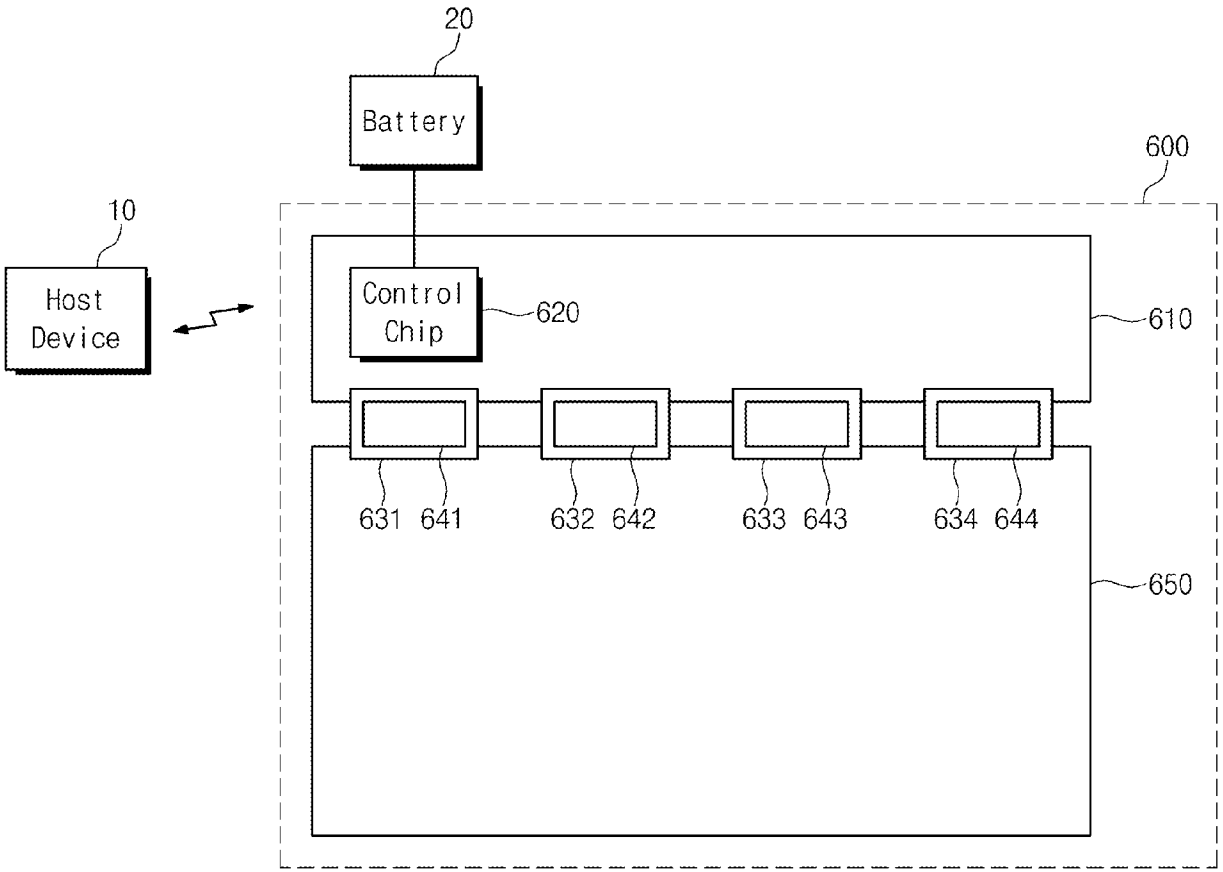
FIG. 8 is a block diagram showing a display apparatus according to an exemplary embodiment of the present disclosure.

FIG. 8 is a block diagram showing a display apparatus according to an exemplary embodiment of the present disclosure.

Referring to FIG. 8, a display apparatus 600 includes a circuit board 610, data driving circuits 631 to 634, and a display panel 650. Data driving integrated circuits 641 to 644 are respectively mounted on the data driving circuits 631 to 634.

The display apparatus 500 shown in FIG. 7 includes the control board 510 separated from the circuit board 520, but a control chip 620 of the display apparatus 600 shown in FIG. 8 is mounted on the circuit board 610. The circuit board 610 includes a plurality of lines connected between the control chip 620 and the data driving circuits 631 to 634.

The control chip 620 communicates with the host device 10 over wireless network and receives the source voltage from the battery 20.

Figure 9:
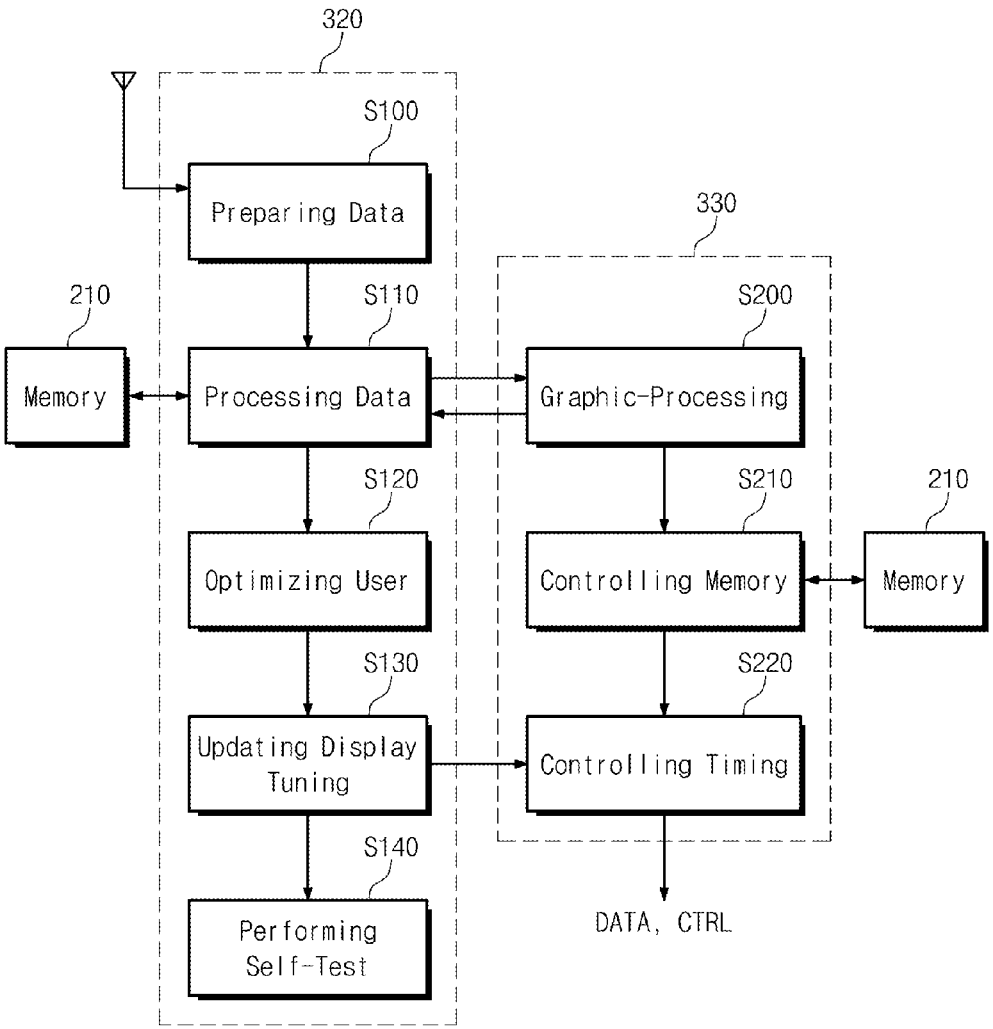
FIG. 9 is a flowchart showing an operation of a processor and a field-programmable gate array in the control board shown in FIG. 5.

FIG. 9 is a flowchart showing an operation of the processor and the field-programmable gate array in the control board shown in FIG. 5.

Referring to FIGS. 5 and 9, the processor 320 prepares data (S100). The processor 320 communicates with the host device 10 over wireless network using at least one of WiHD, WHDi, WiFi, Bluetooth, Zigbee, or binary CDMA. The processor 320 converts the signal IN from the host device 10 to the image signal suitable for the display apparatus 100 shown in FIG. 1.

The processor 320 processes the data. The processor 320 applies the converted image signal to the FPGA 330. The FPGA 330 performs a floating point calculation, a pipeline calculation, a scheduler, and a rendering process and applies the performing result to the processor 320 (S110). The processor 320 stores the processed data into the memory 210. The processor 320 performs an optimization process on the user (S120). The processor 320 sets operation parameters of the display apparatus 100 in response to demand of the user.

The processor 320 performs a display tuning update (S130). When the parameters of the display apparatus 100 are required to be changed in accordance with the demand of the user while the display apparatus 100 is operated, the processor 320 performs the updating process on the parameters set in the timing controller 332 of the FPGA.

The processor 320 performs the self-test process (S140). The processor 320 may test whether or not the display apparatus 100 is operated normally and the parameters are set to appropriate values through the self-test process.

The FPGA 330 performs a control operation to store the graphic-processed image signal into the memory 210 (S210). In addition, the timing controller 332 of the FPGA 330 applies the data signal DATA and the control signal CTRL to the first and the second circuit board 120 and 130 (S220).

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a plurality of pixels connected to a plurality gate lines and a plurality of data lines;

a gate driver configured to drive the gate lines;

a data driver including a plurality of data driving parts configured to drive the data lines;

a first circuit board electrically connects a first data driving part among the plurality of the data driving parts to a control board; and a second circuit board electrically connects a second data driving part among the plurality of the data driving parts to the control board, wherein the control board includes a display control chip, the display control chip comprising:

a processor that converts a frequency of an image signal to be suitable for the display apparatus and outputs the converted image signal and a control signal, and a timing controller that receives the converted image signal and the control signal from the processor and outputs a first control signal to control the gate driver and a second control signal and a data signal to control the data driver in response to the converted image signal and the control signal.

2. The display apparatus of claim 1, wherein the processor communicates with an external device over wireless network using at least one of WiHD (wireless HD), WHDi (wireless home digital interface), WiFi (wireless LAN), Bluetooth, Zigbee, or binary CDMA (code division multiple access).

3. The display apparatus of claim 1, wherein the control board further comprises a wireless interface to communicate with an external device over wireless network using at least one of WiHD (wireless HD), WHDi (wireless home digital interface), WiFi (wireless LAN), Bluetooth, Zigbee, or binary CDMA (code division multiple access).

4. The display apparatus of claim 1, wherein the timing controller is realized by a field-programmable gate array (FPGA) and connected to the processor through a bus.

5. The display apparatus of claim 4, wherein the bus is suitable for an advanced microcontroller bus architecture and protocol standard.

6. The display apparatus of claim 4, wherein the FPGA further comprises a memory management module, a display tuning module, and a graphic processor, wherein the memory management module manages to access the memory, the display tuning module changes a characteristic parameter of the processor, and the graphic processor performs graphic processing on the image signal and provides the processed image to the processor.

7. The display apparatus of claim 6, wherein the control board further comprises:

a memory;

a first bus that connects the memory and the processor; and a second bus that connects the memory and the field-programmable gate array.

8. The display apparatus of claim 1, wherein the control board further comprises a power management unit to manage a source voltage required to drive the display apparatus, the power management unit is connected to a rechargeable battery and charges the battery when the battery is connected to an external source.

9. The display apparatus of claim 8, wherein the battery is disposed on a rear surface of the display apparatus.

10. The display apparatus of claim 1, wherein the processor comprises:

a display tuning unit that changes an operation parameter of the timing controller;

an image processing unit that processes an image information from an external source to output the image signal; and a video post processor that changes a frequency of the image signal to apply the image signal having the changed frequency to the timing controller.

11. The display apparatus of claim 1, wherein the processor is an advanced RISC machines processor.

12. The display apparatus of claim 1, wherein the first circuit board electrically connects the first data driving part and the control board and the second circuit board electrically connects the second data driving part and the control board.

13. The display apparatus of claim 1, wherein the control board is mounted on the first circuit board or the second circuit board, and the first and second circuit boards are electrically connected to each other.

14. The display apparatus of claim 1, further comprising:

a first cable that electrically connects the first circuit board and the control board; and a second cable that electrically connects the second circuit board and the control board.

15. A method of driving a display apparatus, comprising:

preparing a data using a signal applied to a processor from a host device;

performing a graphic process on the data using the processor, wherein the processor converts a frequency of an image signal to be suitable for the display apparatus;

applying the graphic-processed data to the timing controller;

controlling the timing controller to allow an image to be displayed on the display apparatus on the basis of the graphic-processed data; and changing a parameter set in the display apparatus using the processor in accordance with a user's set, wherein the processor and the timing controller are on a same chip.

16. The method of claim 15, wherein the signal is applied to the process in a wireless communication from the host device.

17. The method of claim 15, further comprising performing a self-test function.

18. The method of claim 15, wherein the timing controller is realized by a field-programmable gate array (FPGA) and connected to the processor through a bus.

* * * * *